US010722904B2

(12) United States Patent
Widell et al.

(10) Patent No.: US 10,722,904 B2
(45) Date of Patent: Jul. 28, 2020

(54) PROCESS TO TREAT MAGNETITE ORE AND COLLECTOR COMPOSITION

(71) Applicant: Akzo Nobel Chemicals International B.V., Amhem (NL)

(72) Inventors: Mikael Ivar Widell, Hålta (SE); John André Janiak, Göteborg (SE); Jan Olof Gustafsson, Kungälv (SE); Henrik Nordberg, Stenungsund (SE)

(73) Assignee: NOURYON CHEMICALS INTERNATIONAL, B.V., Arnhem (NL)

( * ) Notice: Subject to any disclaimer, the term of this patent is extended or adjusted under 35 U.S.C. 154(b) by 0 days.

(21) Appl. No.: 16/311,288

(22) PCT Filed: Jul. 5, 2017

(86) PCT No.: PCT/EP2017/066709
§ 371 (c)(1),
(2) Date: Dec. 19, 2018

(87) PCT Pub. No.: WO2018/007419
PCT Pub. Date: Jan. 11, 2018

(65) Prior Publication Data

US 2019/0240677 A1 Aug. 8, 2019

(30) Foreign Application Priority Data

Jul. 8, 2016 (EP) ..... 16178726

(51) Int. Cl.
*B03D 1/02* (2006.01)
*B03D 1/004* (2006.01)
*B03D 1/01* (2006.01)

(52) U.S. Cl.
CPC ..... *B03D 1/0043* (2013.01); *B03D 1/01* (2013.01); *B03D 1/02* (2013.01); *B03D 2201/02* (2013.01); *B03D 2203/04* (2013.01)

(58) Field of Classification Search
CPC ..... B03D 1/0043
See application file for complete search history.

(56) References Cited

U.S. PATENT DOCUMENTS 3,363,758 A 1/1968 Cronberg et al.
4,168,227 A 9/1979 Polgaire et al.
(Continued)

FOREIGN PATENT DOCUMENTS

CA 1100239 4/1981
CN 101795776 A 8/2010
(Continued)

OTHER PUBLICATIONS

Guo Fang, et al.; "Improving the Grade of a Siliceous-Calcareouse Phospate Ore with Fine Size by Reverse Flotation Method"; College of Chemical Engineering, 2010; 1 pg.
(Continued)

*Primary Examiner* — Peter Keyworth
(74) *Attorney, Agent, or Firm* — Lorenz & Kopf, LLP

(57) ABSTRACT

The present invention relates to a collector composition containing 80 to 100 wt % of at least one alkylethermonoamine, less than 20 wt % alkyletherdiamine, all wt % based on total weight of all amine components, and wherein the alkylethermonoamine contains between 60 and 93% isotridecyl(C13)etherpropylamine, 5 and 30% of isododecyl (C12)etherpropylamine, 0 and 10% of isoundecyl(C11)-etherpropylamine, 0 and 10% of isodecyl(C10) etherpropylamine, 2 and 10% tetradecyl(C14)
(Continued)

Grade $SiO_2$ versus Fe recovery with comparative composition 1 and composition 2 on ore etherpropylamine, all % being based on total weight of alkylethermonoamine and the use thereof in a process to treat iron ore.

17 Claims, 1 Drawing Sheet

(56) References Cited

U.S. PATENT DOCUMENTS

| | | | |
|---|---|---|---|
| 4,319,987 | A | 3/1982 | Shaw et al. |
| 6,076,682 | A | 6/2000 | Gustafsson et al. |
| 2012/0325725 | A1 | 12/2012 | Pedain et al. |
| 2013/0277280 | A1 | 10/2013 | Gustafsson et al. |
| 2014/0021104 | A1 | 1/2014 | Bittner et al. |
| 2014/0048455 | A1 | 2/2014 | Bittner et al. |
| 2014/0144290 | A1 | 5/2014 | Martins |

FOREIGN PATENT DOCUMENTS

| | | | |
|---|---|---|---|
| CN | 103260765 | A | 8/2013 |
| CN | 103476506 | A | 12/2013 |
| CN | 103501915 | A | 1/2014 |
| CN | 104919062 | A | 9/2015 |
| EA | 201391473 | A1 | 4/2014 |
| EP | 2 017 009 | A1 | 1/2009 |
| FR | 2 489 714 | A1 | 3/1982 |
| FR | 2 529 475 | A1 | 1/1984 |
| RU | 2469794 | C2 | 12/2012 |
| RU | 2599113 | C1 | 10/2016 |
| WO | 93/06935 | A1 | 4/1993 |
| WO | 2008/077849 | A1 | 7/2008 |
| WO | 2009/077015 | A1 | 6/2009 |
| WO | 2018/007418 | A2 | 1/2018 |

OTHER PUBLICATIONS

Howard James Haselhuhn III; "The Dispersion and Selective Flocculation of Hematite Ore"; Michigan Technical University, 2015.

Mark Ma; "Froth Flotation of Iron Ores"; International Journal of Mining Engineering and Mineral Processing; 2012; 1(2); pp. 56-61; Scientific & Academic Publishing.

Notification of Transmittal of the International Search Report and the Written Opinion of the International Searching Authority, or the Declaration from the International Bureau of WIPO for International Application No. PCT/EP2017/066709 dated Oct. 16, 2017.

European Search Report issued in the counterpart European Application No. 16178726.2-1370 dated Jan. 5, 2017.

Russian Patent Office, Search Report issued in the Notice of Allowance for Russian Patent Application No. 2019102712, dated Jul. 2, 2019.

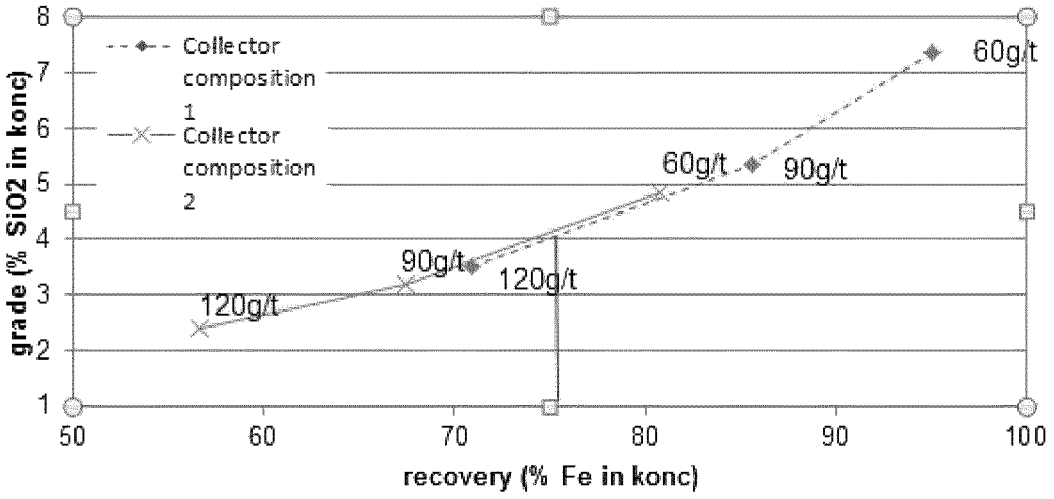
Figure 1. Grade $SiO_2$ versus Fe recovery with comparative composition 1 and composition 2 on ore
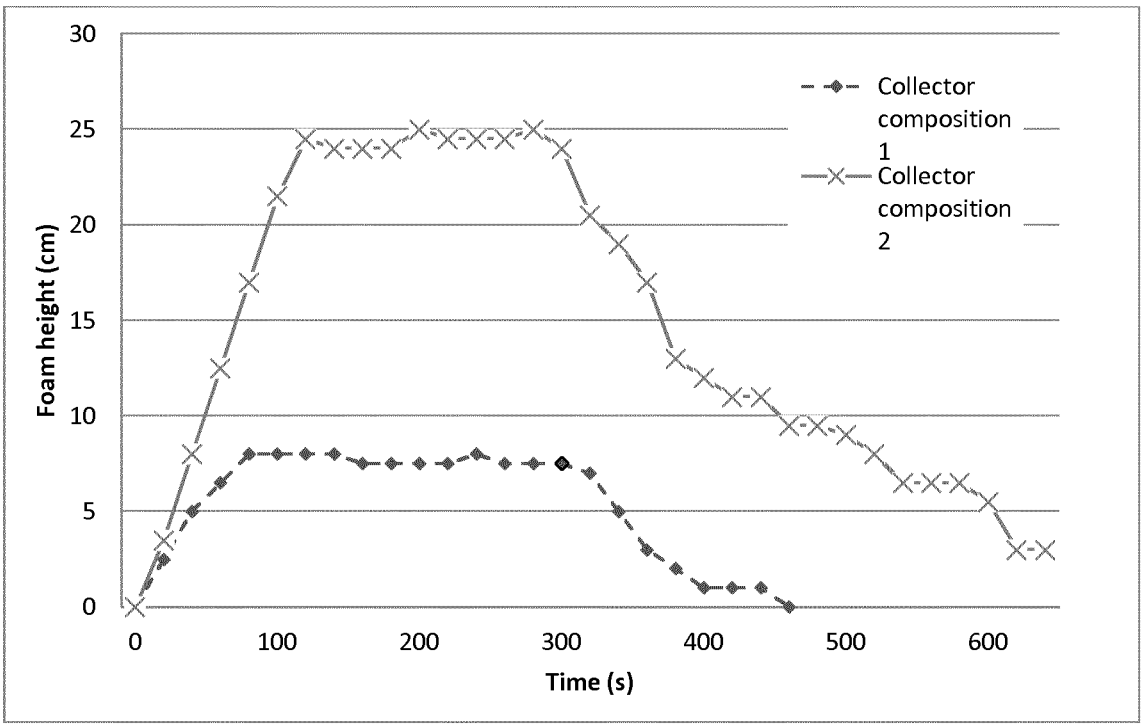
Figure 2. Froth height vs time created by comparative collector composition 1 (110 g/t) and collector composition 2 (80 g/t) with ore. These dosages are needed in order to get approximately 74% Fe recovery at 4% of SiO2 grade.

PROCESS TO TREAT MAGNETITE ORE AND COLLECTOR COMPOSITION

This application is a national stage filing under 35 U.S.C. § 371 of PCT/EP2017/066709, filed Jul. 5, 2017, which claims priority to European Patent Application No. 16178726.2 filed Jul. 8, 2016, the contents of which are each incorporated herein by reference in their entireties.

The present invention relates to a collector composition containing alkylethermonoamine and a process to treat ores, like magnetite ores, with such collector composition.

US 2012/0325725 discloses a flotation reagent for iron ores that contains a composition containing a diamine alkoxylate ester A and an amine B. The amine B may be an etheramine (II) or etherdiamine (III) and many examples of both the etheramines and diamines are mentioned. The use of only or mainly an ethermonoamine is discouraged as it is shown that using a C10ethermonoamine is less effective than using the same compound in combination with a diamine alkoxylate ester compound.

US2014/0021104 discloses a branched C10ethermonoamine for use in a process for enriching an iron mineral from a silicate containing iron ore. The C10ethermonoamine may be used in an admixture with a C13-C15ethermonoamine. This second component has a degree of branching of 0.3 to 0.7. The compounds are used in hematite ores flotation.

US2014/0144290 discloses mixed collector compositions containing an amidoamine and etheramine or etherdiamine. One example of the etheramine is isotridecyloxypropylamine. The mixtures are said to be useful for many separations such as for magnetite. In the Examples it is shown that using only an etheramine gives less favorable results than when mixing with the amidoamine in an undefined type of iron ore, using a branched C10 alkyl-enriched alkylethermonoamine as the etheramine.

WO 2008/077849 discloses amine formulations for reverse froth flotation of silicates from iron ores which are a mixture of an etherdiamine with a second compound that may an ethermonoamine. The ethermonoamine in an explicit embodiment is isotridecoxypropylamine mixed 50/50 with the corresponding diamine. In general the ore is said to be a hematite or magnetite ore, the one used in the Example seems to be undefined.

U.S. Pat. No. 3,363,758 discloses the use of etheramines in froth flotation such as to separate siliceous materials from iron ore such as magnetite. The etheramine can preferably be a C7-13etheramine, and explicit examples include an unbranched n-tridecoxypropylamine.

WO 93/06935 discloses the flotation of iron ores by using a collector containing an etheramine and another anionic or nonionic collector. The etheramine is a C6-C22 ether mono-, di-, tri- or tetraamine. The ores can in general be hematite or magnetite. One collector is a C8-C12etherpropylamine for use in hematite ore treatment. The results suggest that the ethermonoamine is beaten by the etherdiamine for magnetite treatment, as for magnetite only diamines are explicitly disclosed.

US2014/0048455 discloses the use of ether mono- and diamines in flotation for enriching an iron mineral from silicate-containing iron ore. The preferred etheramine is a branched C13alkyletherpropylamine, wherein the alkyl group is—as it is based on Tridecanol N ex BASF—around 99% C13 alkyl. The results presented in the document suggest that the ethermonoamine is beaten by the corresponding etherdiamine in performance in hematite. The document suggests that the formulations disclosed therein will also work for other iron ores, especially iron ores with high silica content, although no results are presented as evidence of this.

There is a continued need for collector compositions that provide a higher efficiency, in particular in terms of a better selectivity in separation of desired components and impurities, and hence an improved and higher recovery of magnetic iron oxide ores.

The present invention provides a collector composition suitable for treating iron ores that contains 80 to 100 wt % of alkylethermonoamine, less than 20 wt % alkyletherdiamine, all wt % based on total weight of all amine components, and wherein the alkylethermonoamine contains between 60 and 93% isotridecyl(C13)etherpropylamine, 5 and 30% of isododecyl(C12)-etherpropylamine, 0 and 10% of isoundecyl(C11)etherpropylamine, 0 and 10% of isodecyl(C10)etherpropylamine, 2 and 10% tetradecyl (C14)-etherpropylamine, all % being based on total weight of alkylethermonoamine, and a process to treat magnetite ore using the above collector composition, the process containing a step of (froth) flotating the ore in the presence of a collector composition.

BRIEF DESCRIPTION OF THE DRAWINGS

The advantages of the present disclosure will be readily appreciated as the same becomes better understood by reference to the following detailed description when considered in connection with the accompanying drawings.

FIG. 1 is a graph of Grade $SiO_2$ versus Fe recovery of comparative collector composition 1 and collector composition 2 with ore.

FIG. 2 is a graph of a froth height versus time of comparative collector composition 1 and collector composition 2 with ore.

DETAILED DESCRIPTION

We have found that collector compositions containing specific monoamine mixtures are much more efficient than diamines or other monoamine-containing compositions in treating iron ores, such as magnetite ores, in a (reverse) flotation process. It has been established that the use of a collector composition containing as amines predominantly alkylethermonoamines of the claimed composition provides for unexpected good results in a flotation process to remove silica from magnetite ore, said results being 30% better than for corresponding alkyletherdiamines and also significantly better than for compositions that contain mainly or only isotridecanol(C13) based monoamines. Besides, diamines are less desirable from a health, safety and environmental perspective as they are associated with higher toxicity compared to monoamines.

Magnetite ores are magnetic iron oxide ores that contain magnetite, i.e. Fe3O4. Such ores are typically called magnetite ores, but also other ores can contain magnetite, which in some cases are referred to as magnetic ores, like magnetic taconite ores. Magnetite ores can be distinguished from hematite ores which contain hematite, i.e. Fe2O3.

By "the degree of branching" (DB) as used herein is meant the total number of (terminal) alkyl—such as methyl—groups present on the alkyl chain minus one. It should be noted that degree of branching is an average value for the (alkyl group in the) alkylethermonoamine and hence does not have to be an integer.

The alkylethermonoamine contains between 60 and 93% isotridecyl(C13)-etherpropylamine, 5 and 30% of isododecyl cyl(C12)etherpropylamine, 0 and 10% of isoundecyl(C11) etherpropylamine, 0 and 10% of isodecyl(C10)-etherpropylamine, 2 and 10% tetradecyl(C14)etherpropylamine, all % being based on total weight of alkylethermonoamine.

Preferably, the alkylethermonoamine contains between 60 and 80 wt % isotridecyl(C13)etherpropylamine, 10 and 30% of isododecyl(C12)-etherpropylamine, 0 and 10% of isoundecyl(C11)etherpropylamine, 0 and 5% of isodecyl(C10) etherpropylamine, 2 and 10% tetradecyl(C14)-etherpropylamine, all % being based on total weight of alkylethermonoamine.

Most preferably, the alkylethermonoamine contains between 65 and 75 wt % isotridecyl(C13)etherpropylamine, 15 and 25% of isododecyl(C12)-etherpropylamine, 0.5 and 5% of isoundecyl(C11)etherpropylamine, 0.1 and 3% of isodecyl(C10)etherpropylamine, 4 and 9% tetradecyl(C14)-etherpropylamine, all % being based on total weight of alkylethermonoamine.

In a preferred embodiment the degree of branching of the alkylethermonoamine, and the optionally present alkyletherdiamine in the composition, is between 1.5 and 3.5, more preferred it is from 2.0 to 3.0.

In another preferred embodiment the collector composition contains less than 10 wt %, even more preferably less than 5 wt % of alkyletherdiamine on total amine components.

The invention in an embodiment also relates to a process to treat iron ore to enrich iron from silica, wherein the iron ores are preferably magnetite ores.

The alkyletherpropylamine compound may be made by reaction of an alkyl alcohol (fatty alcohol) with acrylonitrile, whereafter the obtained intermediate containing a nitrile group is hydrogenated to make primary amine, and the obtained product optionally is partially neutralized.

The collector composition in an embodiment may contain further components that are known to the skilled person to be of benefit in a process to treat iron ores, such as but not limited to (iron) depressants, frothers/froth modifiers/froth regulators/defoamers, secondary collectors, neutralizing agents, pH regulators, cationic surfactants.

It has been found that the efficiency of the flotation process can be improved when the amine is at least partially neutralized by an acid. The amine may be fully or partially neutralized. Preferably, the amine may be neutralized with a 30 to 70% on molar basis amount of acid, preferably between 40 and 60 molar %. The neutralizing agent can be an inorganic acid, such as hydrochloric acid, or preferably a carboxylic acid, more preferably a C1-C5 carboxylic acid, such as formic acid, acetic acid and propionic acid. In one most preferred embodiment, the amine is neutralized with acetic acid.

The collector composition may in an embodiment additionally contain a secondary collector to improve performance. The secondary collector is preferably selected from the group of nonionics, like unbranched and branched fatty alcohols, alkoxylated fatty alcohols, fatty amines, alkylamidoamines, preferably fatty alcohols, or alkoxylated fatty alcohols. Examples of secondary collectors in a more preferred embodiment are branched 011-017 fatty alcohols, such as iso 013 fatty alcohols, and their ethoxylates and propoxylates.

The weight ratio between the primary collector and the secondary collector is preferably from 15:85, more preferably 20:80, most preferably 25:75 to 99:1, preferably 98:2, most preferably 97:3. All weight ratios herein refer to the ratio of active materials, unless stated otherwise.

The flotation process of the invention is preferably a reversed flotation process. Reversed flotation means that the desired ore is not concentrated in the froth, but in the residue of the flotation process. The process of the invention is preferably a reversed flotation process for magnetite ores, more preferably for ores that contain more than 80 wt % of Fe3O4 on total iron oxide content, even more preferably more than 90 wt %, most preferably 95 to 100 wt %. In another preferred embodiment the ores contain less than 15 wt % of silica, even more preferably less than 12 wt %, most preferably less than 10 wt %, on total solids weight in the ore. In a reversed flotation process for concentrating magnetite iron ores, the pH during flotation in a preferred embodiment is suitably in the range of 5-10, preferably in the range of 7 to 9.

The reversed froth flotation process of the invention in an embodiment comprises the steps of

- mixing a ground iron, preferably magnetite, ore with an aqueous medium, preferably water;
- optionally, concentrating the medium with magnetic separation;
- optionally, conditioning the mixture with a depressant;
- optionally, adjusting the pH;
- conditioning the mixture with collector composition as defined herein;
- introducing air into the conditioned water-ore mixture;
- skimming off the froth formed.

The collector composition of the present invention is very beneficially used in a reversed froth flotation process as claimed, especially in a reversed froth flotation process of magnetite ores to enrich iron.

The composition is preferably liquid at ambient temperature, i.e., at least in the range of 15 to 25° C.

The process of the invention may involve other additives and auxiliary materials that can be typically present in a froth flotation process, which additives and auxiliary materials can be added at the same time or preferably separately during the process. Further additives that may be present in the flotation process are (iron) depressants, frothers/froth regulators/froth modifiers/defoamers, cationic surfactants (such as alkylamines, quaternized amines, alkoxylates), and pH-regulators. Depressants include polysaccharides, e.g. dextrin, starch, such as maize starch activated by treatment with alkali, or synthetic polymers such as polyarylamides. Other examples of (hydrophilic) polysaccharides are cellulose esters, such as carboxymethylcellulose and sulphomethylcellulose; cellulose ethers, such as methyl cellulose, hydroxyethylcellulose and ethyl hydroxyethylcellulose; hydrophilic gums, such as gum arabic, gum karaya, gum tragacanth and gum ghatti, alginates; and starch derivatives, such as carboxymethyl starch and phosphate starch. The depressant is normally added in an amount of about 10 to about 1,000 g per ton of ore. After conditioning of the ore, the ether monoamine can be added, preferably partially neutralized, and the mixture is further conditioned for a while before the froth flotation is carried out. If desired, froth regulators can be added before the froth flotation. Examples of suitable froth regulators are methylisobutyl carbinol and alcohols having 6-12 carbon atoms which optionally are alkoxylated with ethylene oxide and/or propylene oxide, especially branched and unbranched octanols and hexanols. After completion of the flotation, a silicate-enriched flotate and a bottom fraction rich in iron and poor in silicate can be withdrawn.

In another aspect, the present invention relates to a pulp comprising crushed and ground iron, preferably magnetite, ore, the collector composition as defined herein, and optionally further flotation aids. These flotation aids may be the same as the above other additives and auxiliary materials which can be typically present in a froth flotation process.

The amount of the collector used in the process of reversed flotation of the present invention will depend on the amount of impurities present in the ore and on the desired separation effect, but in some embodiments will be in the range of from 1-500 g/ton dry ore, preferably in the range of from 10-200 g/ton dry ore, more preferably 20-120 g/ton dry ore.

EXAMPLES

Example 1

Materials and Method

Ore in Flotation Tests:

Magnetite ore: $Fe_3O_4$—87% (Fe—63.0%), $SiO_2$—9.7%, −44 μm—96%

Flotation Chemicals

Collector composition 1 (comparative) containing about 10 wt % acetic acid and about 90 wt % alkyletherpropylaminepropylamine (i.e. a diamine) wherein the alkyl has a degree of branching of about 3.0 and about 70% of the alkyl group is C13, about 20% C12 and the remainder C11 or lower or C14 or higher alkyl. Collector composition 2 containing about 10 wt % acetic acid and about 90 wt % alkyletherpropylmonoamine wherein the alkyl has a degree of branching of about 3.0 and about 70% of the alkyl group is C13, about 20% C12 and the remainder C11 or lower or C14 or higher alkyl.

Synthetic Process Water

Synthetic process water was used in the flotation tests. It was prepared by adding appropriate amounts of commercial salts to deionized water, following the composition described by chemical analysis of process water from plant, Table 1.

TABLE 1

Composition of flotation process water used in in the lab tests

| pH | Ca, mg/l | Mg, mg/l | $SO_4$, mg/l | Cl, mg/l | $HCO_3$, mg/l |
|---|---|---|---|---|---|
| Approx.. 8 | 70 | 65 | 900 | 1000 | 85 |

Flotation Procedure

The study was done as a stepwise rougher flotation with a Denver laboratory flotation machine. The machine was modified and equipped with an automatic froth scraping device and a double lip cell. For apparatus parameters see Table 2.

The ore sample was added to the flotation cell and the cell filled with synthetic process water (37% solids). Water temperature of 19-22° C. was used as standard. The rotor speed was constant during the test, 900 rpm.

1. The pulp was conditioned for 2 minutes.
2. The collector solution (1 wt %) was added and conditioned for 2 minutes.
3. Air and automatic froth skimmer were switched on at the same time
4. The flotation continued for 3 minutes. Water was added continuously by a tube below the pulp surface to keep the right pulp level.
5. The flotation was repeated twice from (2).

The material from the different flotation steps was then dried, weighed out and analyzed for iron and silica content with XRF method.

TABLE 2

Flotation machine parameters

| Denver flotation machine | |
|---|---|
| Cell volume (l) | 1.3 |
| Solids in pulp (%) | 37 |
| Rotor speed (rpm) | 900 |
| Airflow (l/min) | 2.5 |
| Scrape frequency ($min^{-1}$) | 15 |

Preparation of Chemicals

The collectors were dispersed in water and added as a 1%-solution.

Frothing Procedure conditioning of the collector and mineral slurry in the process water for 2 minutes at 900 rpm aeration at a constant rate of 2.5 L/min;

the froth formation was followed for 10 minutes or until the maximum height was reached and stabilized;

the froth formation and froth breakage was followed by measuring the height of the froth every 20 seconds during each process.

Results

The results of the flotation process are given in below Table 3

TABLE 3

| | Fe-concentrate | | | | | | | | |
|---|---|---|---|---|---|---|---|---|---|
| | Total Dosage (g/t) | | | Fe-Recovery (%) | | | Grade SiO2 (%) | | |
| | step 1 | step 2 | step 3 | step 1 | step 2 | step 3 | step 1 | step 2 | step 3 |
| Collector composition 2 | 60 | 90 | 120 | 80.74 | 67.39 | 56.59 | 4.84 | 3.19 | 2.40 |
| Comparative composition 1 | 60 | 90 | 120 | 95.10 | 85.60 | 70.93 | 7.36 | 5.35 | 3.50 |

Flotation

As one can see from Table 3 and FIG. 1, collector compositions 1 and 2 have the same selectivity: at the same grade both surfactants provide the same recovery.

However, the efficiency of these two surfactants is different: in order to obtain 74% Fe recovery around 110-115 g/t of comparative collector composition 1 is needed and 75-80 g/t of collector composition 2 (FIG. 1).

Frothing

In order to show the frothing properties of the collector compositions two frothing experiments were conducted with ore. Dosages of the surfactants needed to obtain 74% Fe recovery were used (FIG. 1).

As one can see from the results, collector composition 2 in accordance with the present invention creates more froth than comparative collector composition 1, but the created froth is breaking fast (see FIG. 2).

Conclusions

It was found that the efficiency of collector composition 2 is at least 30% higher at the same grade/recovery target than the one provided by comparative collector composition 1. Alkylethermonoamine gives an improved performance in treating low silica magnetite ores when compared to alkyletherdiamine.

Example 2

Materials and Method

Example 2 was performed using the ore and the process as described for Example 1 above unless indicated differently below.

Collector composition 2 containing about 10 wt % acetic acid and about 90 wt % alkyletherpropylmonoamine wherein the alkyl has a degree of branching of about 3.0 and about 70% of the alkyl group is C13, about 20% C12 and the remainder C11 or lower or C14 or higher alkyl was now compared with a Comparative Collector composition 3 in which more than 99% of the alklyletherpropylmonoamine is based on isotridecanol C13 alkyl with a DB of 2.2.

Results

The results of the flotation process are given in Table 4 below.

TABLE 4

| | Fe-concentrate | | | | | | | | |
|---|---|---|---|---|---|---|---|---|---|
| | Total Dosage (g/t) | | | Fe-Recovery (%) | | | Grade SiO2 (%) | | |
| Reagent | step 1 | step 2 | step 3 | step 1 | step 2 | step 3 | step 1 | step 2 | step 3 |
| Collector Composition 2 | 60 | 90 | 120 | 80.74 | 67.39 | 56.59 | 4.84 | 3.19 | 2.40 |
| Comparative Composition 3 | 60 | 90 | 120 | 86.95 | 73.72 | 62.35 | 5.71 | 3.92 | 2.90 |

Conclusions

The key to a successful flotation collector is to have high recovery of the value mineral and high reduction of gangue minerals at the lowest possible dosage of flotation chemicals including the collector. Comparing the results in a grade-recovery plot it is obvious that collector composition 2 of the invention is more efficient than comparative collector compositions 1 and 3 without losing any selectivity.

The invention claimed is:

1. A collector composition comprising 80 to 100 wt % of a mixture of alkylethermonoamines including:

between 60 and 93% by weight isotridecyl(C13)etherpropylamine, between 5 and 30% by weight isododecyl(C12)etherpropylamine, between 0 and 10% by weight isoundecyl(C11)etherpropylamine, between 0 and 10% by weight isodecyl(C10)etherpropylamine, and between 2 and 10% by weight tetradecyl(C14)etherpropylamine, wherein all % are based on a total weight of the mixture of alkylethermonoamines.

2. The collector composition of claim 1 wherein the mixture of alkylethermonoamines includes between 60 and 80% by weight isotridecyl(C13)etherpropylamine, 10 and 30% by weight isododecyl(C12) etherpropylamine, 0 and 10% by weight isoundecyl(C11)etherpropylamine, 0 and 5% by weight isodecyl(C10)etherpropylamine, and 2 and 10% by weight tetradecyl(C14)etherpropylamine, wherein all % are based on a total weight of the mixture of alkylethermonoamines.

3. The collector composition of claim 1 wherein the degree of branching of each alkylethermonoamine is between 1.5 and 3.5.

4. The collector composition of claim 1 further comprising less than 20 wt % of an alkyletherdiamine based on a total weight of all amine components.

5. The collector composition of claim 1 further comprising additives selected from the group of depressants, surfactants, froth modifiers, neutralizing agents, or secondary collectors.

6. The collector composition of claim 5 wherein the neutralizing agents are acetic acid.

7. The collector composition of claim 5 wherein the secondary collectors are selected from the group of branched alkyl fatty alcohols and alkoxylated alkyl fatty alcohols.

8. The collector composition of claim 1 further comprising about 10% by weight of acetic acid.

9. The collector composition of claim 1 wherein the collector composition is free of an alkyletherdiamine.

10. A collector composition comprising:

acetic acid; and a mixture of alkylethermonoamines including:

from 60 to 80% by weight of isotridecyl(C13)etherpropylamine based on a total weight of the mixture of alkylethermonoamines;

from 10 to 30% by weight of isododecyl(C12)etherpropylamine based on a total weight of the mixture of alkylethermonoamines; and the remainder being isoundecyl(C11)etherpropylamine, isodecyl(C10)etherpropylamine, or tetradecyl (C14)etherpropylamine.

11. The collector composition of claim 10 wherein the acetic acid is present in an amount of about 10% by weight and the mixture of alkylethermonoamines is present in an amount of about 90% by weight, with all % based on a total weight of the collector composition.

12. A process to treat iron ore, the process containing a step of (froth) flotating in the presence of a collector composition of claim 1.

13. The process of claim 12 wherein the iron ore is a magnetite ore.

14. The process of claim 13 wherein the process to treat magnetite ore is a process to enrich iron from silicates.

15. The process of claim 12 wherein the process is a reverse flotation process.

16. The process of claim 12 wherein the ore is an ore containing less than 15 wt % of silica based on a total solids weight in the ore.

17. Pulp comprising crushed and ground iron ore, the collector composition of claim 1, and optionally flotation aids.

* * * * *